US006145675A

United States Patent [19]

Kass et al.

[11] Patent Number: 6,145,675

[45] Date of Patent: Nov. 14, 2000

[54] EASY TO LOAD STRIP MERCHANDISER

[75] Inventors: Henrik Kass, Buderim, Australia; Daniel J. Kump, Gates Mills; Stephen D. Wamsley, Lakewood, both of Ohio

[73] Assignee: Fasteners For Retail, Inc., Cleveland, Ohio

[21] Appl. No.: 09/249,732

[22] Filed: Feb. 12, 1999

Related U.S. Application Data

[60] Provisional application No. 60/075,502, Feb. 23, 1998.

[51] Int. Cl.[7] ..... A47G 29/00

[52] U.S. Cl. ..... 211/71.01; 211/85.15; 248/316.7

[58] Field of Search ..... 248/339, 220.21, 248/220.22, 909, 220.31, 220.41, 220.43, 221.11, 221.12, 222.11, 225.11, 225.21, 316.1, 316.7; 211/57.1, 59.1, 73, 113, 118, 85.15, 71.01, 85.29, 85.4; 206/482, 493

[56] References Cited

U.S. PATENT DOCUMENTS

| | | | |
|---|---|---|---|
| 628,784 | 7/1899 | Fitzgerald . | |
| 1,093,856 | 4/1914 | Hurff . | |
| 2,288,706 | 7/1942 | Herr . | |
| 2,462,431 | 2/1949 | Schneider . | |
| 2,514,742 | 7/1950 | Burger et al. . | |
| 3,360,229 | 12/1967 | Beyer . | |
| 3,776,503 | 12/1973 | Boden et al. . | |
| 3,900,110 | 8/1975 | Soroka . | |
| 4,312,449 | 1/1982 | Kinderman . | |
| 4,367,819 | 1/1983 | Lewis . | |
| 4,461,387 | 7/1984 | Belokin, Jr. | 211/71 |
| 4,546,943 | 10/1985 | Fast . | |
| 4,667,827 | 5/1987 | Calcerano . | |
| 4,718,627 | 1/1988 | Fast et al. . | |
| 4,911,392 | 3/1990 | Fast | 248/220.31 |
| 5,087,007 | 2/1992 | Gaderick . | |
| 5,103,970 | 4/1992 | Nielson et al. . | |
| 5,199,578 | 4/1993 | Pendergraph et al. . | |
| 5,284,259 | 2/1994 | Conway et al. | 211/73 |
| 5,339,967 | 8/1994 | Valiulis | 211/57.1 |
| 5,344,003 | 9/1994 | Park . | |
| 5,346,166 | 9/1994 | Valiulis | 248/220.41 |
| 5,377,435 | 1/1995 | Dalton . | |
| 5,386,916 | 2/1995 | Valiulis . | |
| 5,405,022 | 4/1995 | Rissley . | |
| 5,463,827 | 11/1995 | Williams . | |
| 5,553,721 | 9/1996 | Gebka | 211/59.1 |
| 5,697,506 | 12/1997 | Peickert | 211/71 |
| 5,743,403 | 4/1998 | Crysdale | 206/482 |
| 5,743,497 | 4/1998 | Michael | 248/316.7 X |

OTHER PUBLICATIONS

Four photographs of strip merchandiser of Display Masters 30–56 Whitestone Expressway Whitestone N.Y. 11354 Circa 1994.

Fiskars Inc., "Quickstrip" Advertisement, Aug. 1996, 4 pages.

Fasteners For Retail, Inc., "Star Impulse Strip" Advertisement, 1 page, circa 1998.

*Primary Examiner*—Ramon O. Ramirez
*Assistant Examiner*—Gwendolyn Baxter
*Attorney, Agent, or Firm*—Fay, Sharpe, Fagan, Minnich & McKee, LLP

[57] ABSTRACT

An integrally formed elongated plastic strip merchandiser includes a mounting portion and a display portion. The display portion has a plurality of vertically spaced integral tongues for supporting associated merchandise items. Each tongue has a base of one piece with the strip and lying in the plane of the strip and a tip protruding out of the plane of the strip. A pair of tapering sidewalls lead from the base to the tip. A plurality of first shoulders protrude from the strip in a direction approximately normal to the strip. Each first shoulder is located adjacent a respective tongue tip. Preferably, a plurality of second shoulders protrude in a direction approximately normal to the strip. A respective one of the plurality of first shoulders are located on one side of each tongue tip and a respective one of the plurality of second shoulders is located on another side of each tongue tip.

22 Claims, 3 Drawing Sheets

EASY TO LOAD STRIP MERCHANDISER

This application bases its priority on U.S. Provisional Application Ser. No. 60/075,502 dated Feb. 23, 1998.

BACKGROUND OF THE INVENTION

The present invention relates to point of purchase display systems. More particularly, the invention relates to strip merchandisers for product display.

Merchandise presentation must satisfy the requirements of both retailers and suppliers. Retailers demand displays which will allow normal presentation of products, adapt to existing fixtures and require minimal installation, e.g., come with the product loaded and ready to sell. Suppliers need a display which can be assembled and shipped with minimal labor, material and storage requirements.

One known way of display merchandise is via an elongate plastic strip (i.e. a strip merchandiser) which is suspended from the front edge of a merchandise display shelf or the like to itself suspend apertured products, such as blister packs, for display. The strips are usually made from a die cut plastic material and have a series of spaced slits which, when the material is pushed out of the plane of the strip, form integral upwardly facing individual support hooks for the products. Adjacent each upwardly facing hook or tongue are a pair of downwardly facing tongues. The various tongues are defined in the strip merchandiser by a continuous slit. The downwardly facing tongues serve to prevent the package, once it is suspended from the upwardly facing tongue, from being detached therefrom during transit and display. The downwardly facing tongues have to be pushed out of the way in order to allow the package to be unhooked from the upwardly facing tongue. At their upper end, the strips have a mounting portion of one form or another for attaching the strip to the shelf. The loaded strip can thus be hung from price channels, shelves, walls, gondolas, wire racks or S-hooks by the retailer.

When an item of merchandise is removed from the strip, the corresponding support hook remains empty. An accumulation of empty support hooks results in an unappealing merchandise display. It is now known that strip merchandisers can be made with adjacent sections that are separated by a weakened line, such as a score line. This construction allows an empty section of the strip to be either folded behind or torn away from the remaining full sections of the strip.

The problem with all such known merchandisers is that they must be manually flexed through approximately 180 degrees at each hanging point, or hook, in order to allow the merchandise to be hung from the strip. This process of manual flexing is labor-intensive and time consuming. Therefore, it is an expensive process for loading the strips with merchandise.

One known strip merchandiser has a series of vertically spaced tabs that need to be flexed out of the plane of the remainder of the strip merchandiser in order to hang product thereon. However, this known merchandiser includes a pair of securing protrusions one located on either side of a tip of each support hook in order to prevent packages from becoming detached from the hook during transit and display. The disadvantage of this known strip merchandiser is that each hook or tongue must still be flexed out of the plane of the remainder of the strip merchandiser in order to allow merchandise to be hung from the strip. This process of manual flexing of the hooks or tongues is labor intensive and time consuming and hence disadvantageous.

Accordingly, it has been considered desirable to develop a new and improved easy to load strip merchandiser which would overcome the foregoing difficulties and others while providing better and more advantageous overall results.

BRIEF SUMMARY OF THE INVENTION

In accordance with one aspect of the present invention, a strip merchandiser is provided.

More particularly, in accordance with this aspect of the invention, the strip merchandiser comprises an elongated strip of material and at least one tongue disposed on the strip. The at least one tongue comprises a base of one piece with the strip and a tip protruding out of a plane of the strip. A first shoulder protrudes from the strip in a direction approximately normal to the strip.

In accordance with another aspect of the present invention, a strip merchandiser is provided.

More particularly, in accordance with this aspect of the invention, the strip merchandiser comprises an elongated strip of material lying in a plane and having a longitudinal axis. A plurality of tongues are disposed along the longitudinal axis of the strip. Each tongue comprises a base of one piece with the strip and lying in the plane of the strip and a tip protruding out of the plane of the strip. A plurality of first shoulders protrude from the strip in a direction approximately normal to the strip.

In accordance with still another aspect of the present invention, an integrally formed elongated plastic strip merchandiser is provided.

More particularly in accordance with this aspect of the invention, the merchandiser comprises a mounting portion and a display portion. The display portion comprises a plurality of vertically spaced integral tongues for supporting associated merchandise items. Each tongue comprises a base of one piece with the strip and lying in the plane of the strip and a tip protruding out of the plane of the strip. A pair of tapering side walls lead from the base to the tip. A plurality of first shoulders protrude from the strip in a direction approximately normal to the strip, each first shoulder being located adjacent a respective tongue tip.

One advantage of the present invention is the provision of a new and improved strip merchandiser which is easier to load than the currently available strip merchandisers.

Another advantage of the present invention is the provision of a strip merchandiser in which the body of the strip merchandiser need not be manually flexed in order to load the upwardly extending tongues of the merchandiser with packages.

Still another advantage of the present invention is the provision of a strip merchandiser which is less time consuming and less labor intensive to load, and hence less expensive to load, than are the currently available strip merchandisers.

A further advantage of the present invention is the provision of a strip merchandiser having a tongue which is permanently biased away from the plane of a body of the strip merchandiser.

A still further advantage of the present invention is the provision a strip merchandiser which has a tongue which cooperates with the body of the merchandiser to form a pocket in which a package can rest without applying pressure to the tongue to bias the tongue away from the body.

A yet further advantage of the present invention is the provision of a strip merchandiser which has at least one protrusion extending radially away from the plane of a body of the strip merchandiser. Preferably, two protrusions are located, respectively, on either side of a tongue of the strip merchandiser. The protrusions serve as means for preventing a package hooked on the tongue from becoming detached therefrom during transit and display.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
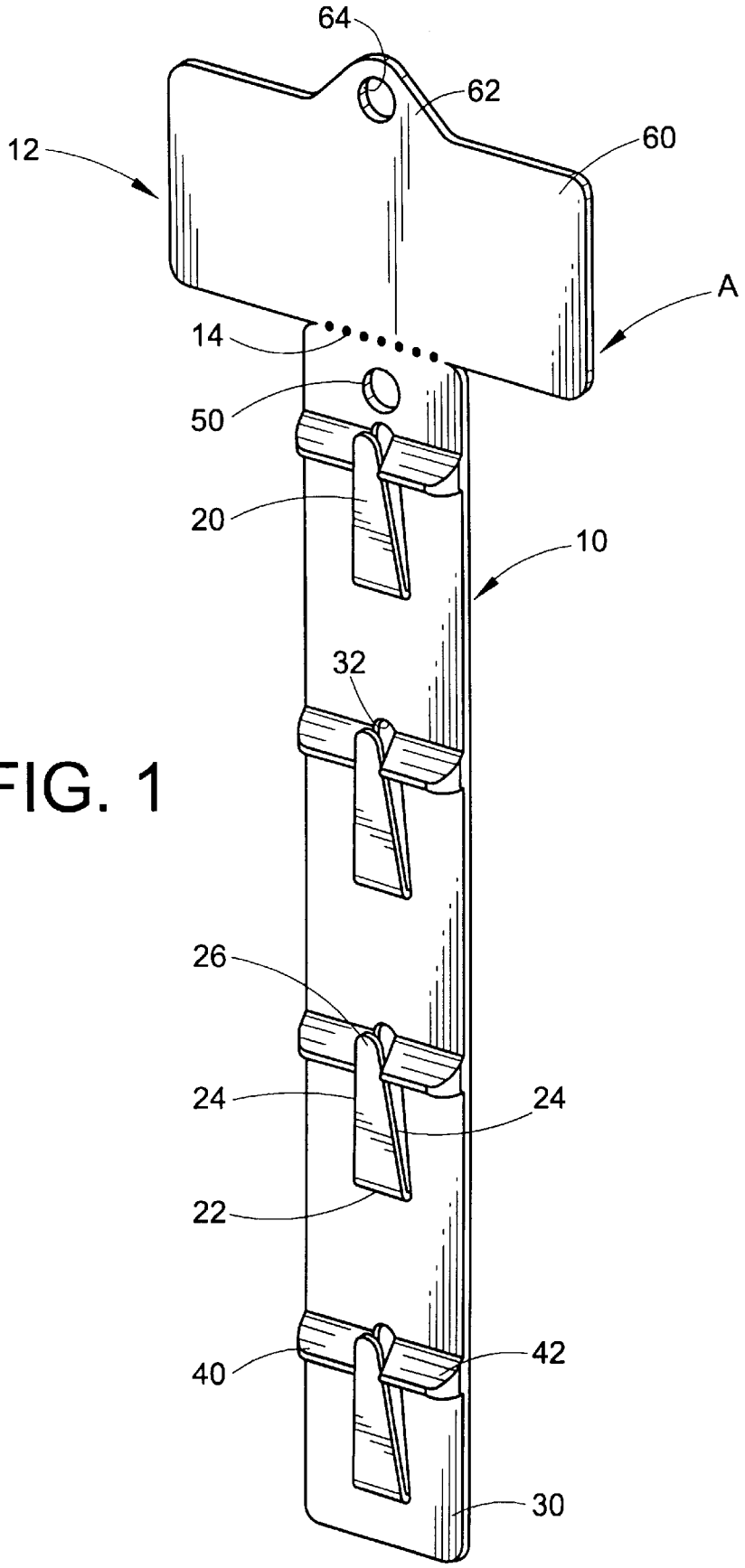
FIG. 1 is a perspective view of a strip merchandiser according to a first preferred embodiment of the present invention.
Figure 2:
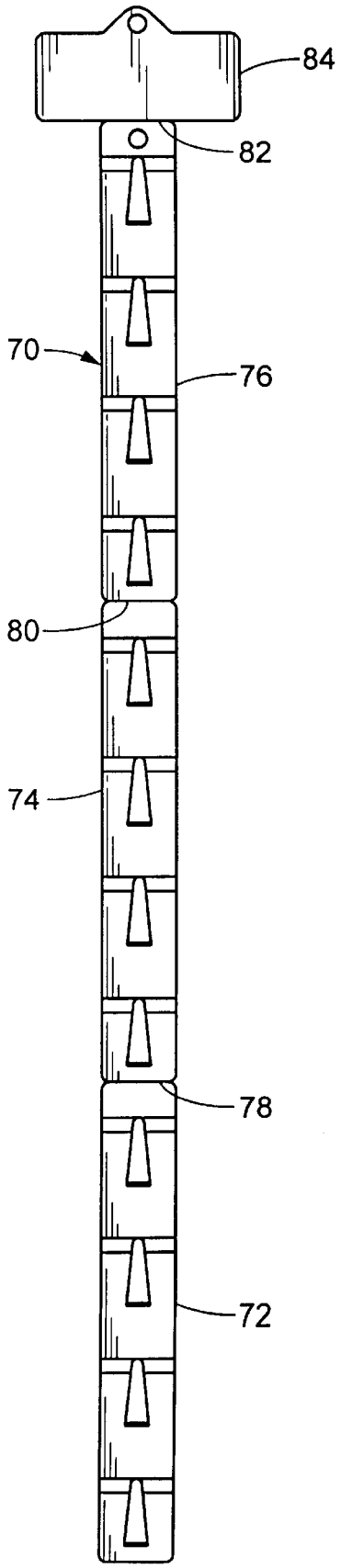
FIG. 2 is a front elevational view of a strip merchandiser accord to a second preferred embodiment of the present invention.

Referring now to the drawings wherein the showings are for purposes of illustrating the preferred embodiments of the invention only and not for purposes of limiting same, FIG. 1 shows a strip merchandiser A which includes a body portion 10 and a mounting portion 12. A perforation line 14 separates the body portion from the mounting portion. While the strip merchandiser A is shown to have a relatively short length with only four protrusions for suspending merchandise, it should be appreciated that a strip merchandiser according to the present invention could be considerably longer. Such a strip merchandiser is illustrated in FIG. 2 and is identified by the letter B.

With continuing reference to FIG. 1, a series of spaced tongues 20 is provided on the body portion. It is evident from FIG. 1 that the tongues protrude out of the plane of the body portion 10. The tongues each include a base 22 by which they are attached to the body portion and two tapered side walls 24 which lead to a rounded tip 26. The tip 26 lies outside the plane of the body portion 10 in order to allow merchandise to more quickly be loaded on the tongue. This construction enhances the tongue's resiliency and flexing ability. The width of the base 22 of each tongue 20 is wider than is the rounded tip 26 of the tongue. Preferably, the cross-sectional area of the tongue 20 is slightly tapered so that the thickness of the material from which the tongue is made is gradually reduced from the base 22 to the tip 26 of the tongue. This again enhances the resilience and flexing ability of the tongue. The smaller rounded tip 26 of the tongue also aids in the loading of the merchandising strip A making it easier to insert the tongue through the holes present in the top of suitable conventional merchandise packaging.

The body portion 10 is divided into a set of panels 30 each containing a tongue 20. Each panel includes an aperture 32 located behind its tongue. Positioned on each panel are a pair of protrusions, namely a first protrusion 40 located on a first side of the aperture 32 and a second protrusion 42 located on a second side of the aperture. The protrusions are so positioned in relation to the tongues 20 as to be adjacent the tips 26 of their respective tongues. The protrusions extend away from the plane of the body portion 10 and have a somewhat triangular shape as may be best seen in FIG. 3.

The protruding tapered tongue flexes slightly during loading so that its tip moves free of the two protrusions 40 and 42. These two protrusions perform the same securing function as do the downwardly pointing tongues present in the conventional strip merchandisers. Namely, the protrusions 40, 42 prevent the merchandise from falling off the respective tongues 20 during transit and display. The tapered tongue 20 is attached to the body portion 10 by the base 22 in such a manner that the base is oriented approximately perpendicular to the body portion. This creates a pocket in which a package can rest without applying pressure to the tongue. In other words, the length of the base 22 is at least equal to the thickness of the material of the package. It should be evident that the tongue 20 is thus made up of two sections the first section being the base 22 and a second section or remainder body portion 28 of the tongue, which is oriented at an acute angle to the plane of the body portion 10. It should be recognized that the number of securing protrusions could be one or more for each tongue depending upon the desired shapes of the securing protrusions.

The top panel 30 of the body portion 10 includes an aperture 50. The aperture is positioned between the perforation line 14 and the adjacent tongue 20. The aperture enables the body panel to be suspended from a suitable hook even if the mounting portion 12 is torn away from the body portion along the perforation line 14.

The mounting portion 12 comprises a panel 60 on which price stickers or labels can be mounted for describing the merchandise held on the strip merchandiser. A tab 62 extends away from a top end of the panel 60 through which an aperture 64 extends. If the mounting portion is employed, a suitable conventional mounting hook or the like (not illustrated) extends through the aperture 64.

While in FIG. 1 a perforation line 14 is shown as being located between the body portion 10 and the mounting portion 12, it should be recognized that the perforation line could be easily eliminated. In such an embodiment, the mounting portion could not be readily detached from the body portion. In one embodiment, the mounting strip A is made from a suitable, conventional thermoplastic material, such as polypropelyne, by a suitable conventional process such as injection molding.

With reference now to FIG. 2, an elongated mounting strip B according to a second preferred embodiment of the present invention is there illustrated. For ease of understanding an appreciation of this embodiment, like components are identified by like numerals with a primed suffix and new components are identified by new numerals. The mounting strip B has an elongated body portion 70 which is divided into sections 72, 74 and 76 by respective perforation lines 78 and 80. An upper perforation line 82 separates the body portion from a mounting portion 84. With this design, when the merchandise has been removed from the bottom portion 72, that portion can be torn away from the remainder of the strip merchandiser along perforation line 78 so as to reduce the length of the strip merchandiser and provide an appealing merchandise display which remains substantially full of product.

Figure 3:
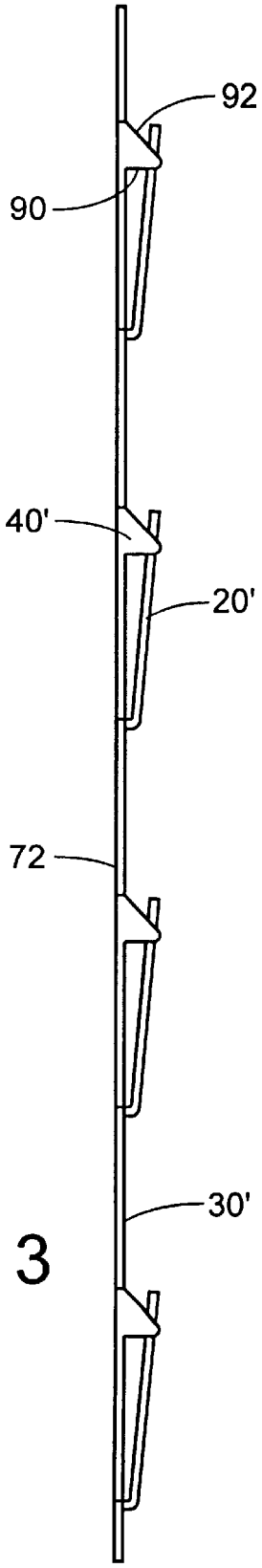
FIG. 3 is an enlarged side elevational view of a bottom portion of the strip merchandiser of FIG. 2.
Figure 4:
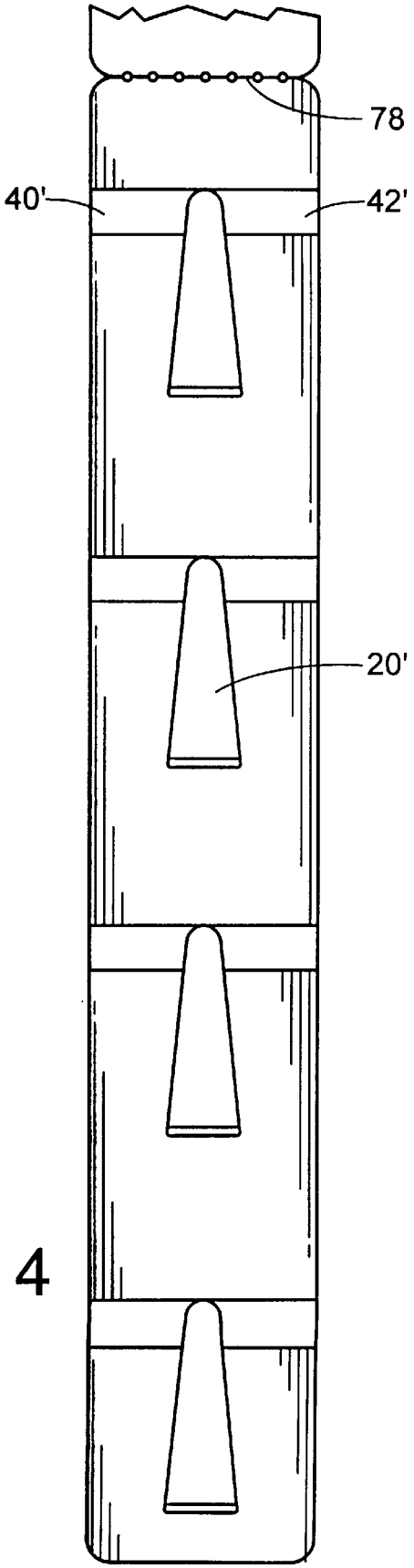
FIG. 4 is an enlarged front elevational view of a bottom portion of the strip merchandiser of FIG. 2.

With reference now to FIG. 3, the bottom portion 72 of the strip merchandiser has four panel sections 30'. In other words, the bottom portion 72 has four tongues 20' and four sets of protrusions. In FIG. 3, only the first protrusion 40' of each set of protrusions is visible. In FIG. 4, however, both protrusions 40' and 42' can be seen. It should be evident from FIG. 3 that the protrusion 40' includes a substantially linear bottom surface 90 which extends approximately perpendicular to the plane of the bottom portion 72. In contrast, a top wall 92 of the protrusion 40' is angled so as to form an acute angle in relation to the plane of the bottom portion 72. Therefore, in cross-section, the protrusion 40' is substantially a right triangle. Employing a bottom surface 90 substantially perpendicular to the plane of the bottom portion 72 is advantageous in that this construction prevents packages from easily sliding off the tongues 20'. In other words, a top surface of a package would abut the bottom surfaces of the protrusions to prevent any further sliding of the package along the tongue 20' toward its tip 26' unless the tongue were pulled forward and away from the protrusions.

The strip merchandiser can be made from any suitable material such as a suitable conventional plastic material, some types of metals or even other materials.

As mentioned, the strip merchandiser according to the present invention has, at each hanging point, an upwardly pointing tapered tongue that is angled such that it protrudes away from a plane extending through the body of the strip merchandiser so that the main body of the strip merchandiser need not be flexed in order to hang merchandise off each upwardly pointing tongue. The protruding tapered tongue flexes slightly during loading so that its tip moves free of two securing protrusions which are preferably closely positioned on either side of the tip of the tongue. These two securing protrusions perform the same function as the two downwardly pointing tongues present in the currently known strip merchandisers in that these protrusions prevent the merchandise from falling off the protruding tapered tongues during transit and display.

The invention has been described with reference to preferred embodiments. Obviously, modifications and alterations will occur to others upon the reading and understanding of the preceding specification. It is intended that the invention be construed as including all such alterations and modifications insofar as they come within the scope of the appended claims or the equivalents thereof.

What is claimed is:

1. A strip merchandiser comprising:

an elongated strip of material;

at least one tongue disposed on said strip, said at least one tongue comprising:

a base of one piece with said strip, a body portion, and a tip protruding out of a plane of said strip, wherein said base is oriented approximately perpendicular to said body portion; and, a first shoulder protruding from said strip in a direction approximately normal to the plane of said strip, each first shoulder comprising a top wall and a bottom wall, said bottom wall being oriented approximately perpendicular to the plane of said elongated strip.

2. The strip merchandiser of claim 1 wherein said first shoulder is aligned with said tip of said at least one tongue.

3. The strip merchandiser of claim 1 further comprising a aperture located in said strip directly behind said tip of said at least one tongue.

4. The strip merchandiser of claim 1 further comprising a second shoulder protruding from said strip in a direction approximately normal to said strip, said first shoulder being located on one side of said tip of said at least one tongue and said second shoulder being located on another side of said tip of said at least one tongue.

5. The strip merchandiser of claim 4 wherein said second shoulder is aligned with said tip of said at least one tongue.

6. The strip merchandiser of claim 1 further comprising a mounting portion.

7. The strip merchandiser of claim 6 wherein said mounting portion comprises a panel for accommodating a label.

8. The strip merchandiser of claim 6 wherein said mounting portion comprises a mounting aperture.

9. The strip merchandiser of claim 6 further comprising a perforation line extending transversely across said strip.

10. The strip merchandiser of claim 1 wherein said base extends approximately normal to the plane of said strip, and said body portion extends at an acute angle to the plane of said strip.

11. A strip merchandiser comprising:

an elongated strip of material lying in a plane and having a longitudinal axis;

a plurality of tongues disposed along said longitudinal axis of said strip, each tongue comprising:

a base of one piece with said strip and extending away from said plane of said strip, and a tip protruding out of said plane of said strip; and, a plurality of first shoulders protruding from said strip, each first shoulder comprising a top wall and a bottom wall, said bottom wall being oriented approximately perpendicular to a plane of said elongated strip.

12. The strip merchandiser of claim 11 wherein each of said plurality of first shoulders is aligned with a respective tip of one of said plurality of tongues.

13. The strip merchandiser of claim 11 further comprising a plurality of pockets defined by said plurality of bases and said elongated strip of material.

14. The strip merchandiser of claim 11 further comprising a plurality of second shoulders protruding in a direction approximately normal to said strip, a respective one of said plurality of first shoulders being located on one side of each tip of said plurality of tongues and a respective one of said plurality of second shoulders being located on another side of each tip of said plurality of tongues.

15. The strip merchandiser of claim 14 wherein each said second shoulder is aligned each said tip of said plurality of tongues.

16. The strip merchandiser of claim 11 further comprising a mounting portion.

17. The strip merchandiser of claim 16 wherein said mounting portion comprises a panel for accommodating a label.

18. The strip merchandiser of claim 16 wherein said mounting portion comprises a mounting aperture.

19. The strip merchandiser of claim 16 further comprising a perforation line extending transversely across said strip.

20. An integrally formed elongated plastic strip merchandiser comprising:

a mounting portion; and, a display portion, said display portion comprising:

a plurality of vertically spaced integral tongues for supporting associated merchandise items, each tongue comprising:

a base of one piece with said strip and extending away from a plane of said strip, a body portion extending at an acute angle to said plane of said strip, a pair of tapering side walls on said body portion leading from said base to a tip, and a plurality of first shoulders protruding from said strip, each first shoulder being located only adjacent a respective tongue tip and being spaced from a respective tongue base and a respective tongue body portion, each first shoulder comprising a top wall and a bottom wall, said bottom wall being oriented approximately perpendicular to said plane of said strip.

21. The strip merchandiser of claim 20 further comprising a plurality of second shoulders protruding in a direction approximately normal to said strip, a respective one of said plurality of first shoulders being located on one side of each tongue tip and a respective one of said plurality of second shoulders being located on another side of each tongue tip.

22. The strip merchandiser of claim 20 wherein each of said first shoulders comprises:

an upper wall which is oriented at an acute angle in relation to a respective one of said plurality of tips to facilitate the hanging of associated merchandise items from said plurality of tongues; and, a lower wall.

* * * * *